United States Patent [19]

Norris

[11] 4,173,372

[45] Nov. 6, 1979

[54] DENTAL CHAIR

[75] Inventor: Floyd E. Norris, Seattle, Wash.

[73] Assignees: Gary Reynolds, Seattle; Harold Y. Tai, Everett, both of Wash.

[21] Appl. No.: 840,716

[22] Filed: Oct. 11, 1977

[51] Int. Cl.[2] ..... A61G 15/00

[52] U.S. Cl. ..... 297/345; 248/421; 297/330

[58] Field of Search ..... 297/330, 345, 346, 348, 297/347; 248/421, 419

[56] References Cited

U.S. PATENT DOCUMENTS

| | | | |
|---|---|---|---|
| 521,256 | 6/1894 | Browne | 248/421 X |
| 2,792,873 | 5/1957 | Herider et al. | 248/421 |
| 3,083,055 | 3/1963 | Davis | 297/345 |
| 3,479,086 | 11/1969 | Sheridan | 297/330 |
| 3,596,982 | 8/1971 | Grams | 297/330 |
| 3,698,673 | 10/1972 | Olsen | 248/421 |
| 3,982,718 | 9/1976 | Folkenroth et al. | 248/421 |

*Primary Examiner*—Francis K. Zugel
*Attorney, Agent, or Firm*—Dowrey & Cross

[57] ABSTRACT

A dental chair comprising a pedestal, a lifting assembly mounted on the pedestal, a parallelogram assembly supported by the lifting assembly, a seat assembly pivotally mounted on the parallelogram assembly, and a backrest assembly pivotally mounted to the seat assembly. The lifting assembly is capable of moving the parallelogram assembly horizontally while simultaneously raising or lowering it, thereby causing the seat and backrest assemblies to move vertically without substantial horizontal motion. The seat assembly is hingedly mounted to the parallelogram assembly and includes a transverse shaft and drive means therefor. Means separately link said shaft to the parallelogram and backrest assemblies, such that rotation of said shaft by its drive means causes simultaneous pivotal motion of the seat and backrest assemblies, thereby permitting adjustment of the seat and backrest of the chair to their most convenient inclinations for a given dental treatment. The entire chair is rotatable on the pedestal, and a locking means including an eccentric linking means is provided for locking the chair in any rotational position.

7 Claims, 10 Drawing Figures

DENTAL CHAIR

FIELD OF THE INVENTION

This invention relates to dental chairs.

BACKGROUND OF THE INVENTION

The great variety of treatments used in modern dentistry makes it necessary for dental chairs to be adjustable so that the dentist can position the patient in the most convenient and comfortable position for each particular treatment. Particular adjustment features should include provision for adjusting the elevation of the chair above the floor, the orientation of the chair, and the inclinations of the seat and backrest portions of the chair. The elevation adjustment mechanism should be as compact as possible without sacrificing strength and safety, so that the dentist's knees can extend under the seat when he is working close to the patient in a seated position. The adjustment mechanism for the seat and backrest inclinations should be interrelated, so that the seat and backrest are always automatically held in the best relative orientation for patient comfort. All adjustment mechanisms should be easy to use and should be as mechanically simple as possible so as to reduce manufacturing and maintenance costs. Finally, the dental chair should be comfortable and should be designed so that it is as easy as possible for the patient to get on and off the chair.

Although a considerable number of dental chairs have heretofore been proposed, none of these prior chairs has been more than partially successful in meeting these objectives. A number of prior dental chairs have included a seat adjustably supported by means of a paralleloram support structure. Although this structure is comparatively simple, it suffers from the disadvantage that the seat moves laterally as it is raised or lowered, a feature which is not only inconvenient for the dentist but also requires a large support structure so that the chair will be stable at all elevations. Dental chair support structures have been devised which reduce or eliminate the lateral movement during raising or lowering of the chair, but at the expense of design simplicity and reliability. A number of dental chairs have been proposed having unitary mechanisms for controlling the inclination of the seat and backrest of a dental chair. These chairs usually involve the chair arms as part of the linkage mechanism. A disadvantage of this approach is that the chair arms cannot be made so that they swing out of the way to facilitate getting on and off the chair. Other approaches to unitary seat and backrest inclination mechanisms have involved almost prohibitive complexity. Finally, dental chairs have been proposed which can be rotated about a vertical axis and locked in any orientation, but none of such chairs have included locking means which are convenient to use.

SUMMARY OF THE INVENTION

This invention provides a dental chair having simple, effective and easily operated mechanisms for adjusting the elevation of the seat, the orientation of the chair, and the inclinations of the seat and backrest. The elevation adjustment comprises a simple parallelogram design in conjunction with a novel lifting assembly which essentially eliminates horizontal movement of the chair as it is raised or lowered. The seat and backrest inclination adjustments are interconnected via a simple and unique linkage so that a single easy-to-use control automatically positions both seat and backrest for maximum comfort and convenience. The dental chair is provided with a novel and easy-to-use locking mechanism for selectively holding the chair in any desired orientation.

The dental chair comprises a pedestal, a lifting assembly mounted on the pedestal, a parallelogram assembly supported by the lifting assembly, and seat and backrest assemblies mounted on the parallelogram assembly. The parallelogram assembly includes upper and lower members joined by arms such that the upper and lower members remain parallel in all relative positions. The lower member is slidably mounted on guide means supported in the lifting assembly and may be caused to move along such guide means by an elevation drive means also supported in the lifting assembly. The lifting assembly further includes elevation link means pivotally connected thereto and to one of the arms of the parallelogram assembly. Such elevation link means translate movement of the lower member along the guide means into vertical motion of the upper member. The upper member carries the seat assembly, and thus activation of the elevation drive means will raise and lower the dental chair without any appreciable horizontal motion thereof.

The seat assembly comprises a seat frame hingedly mounted atop the parellelogram assembly such that the seat can assume both elevated and lowered positions. The backrest assembly comprises a backrest frame hingedly mounted to the seat frame for motion between reclined and upright positions. The seat frame carries a transverse shaft, driving means therefor, and linkages connecting such shaft to the parallelogram assembly and backrest assembly such that rotation of the shaft causes the seat and backrest frames to move in unison between their elevated and reclined positions and their lowered and upright positions respectively. By such means, the seat and backrest may assume a continuous but interrelated range of positions for maximum versatility and patient comfort.

The lifting assembly is mounted on a pedestal such that the lifting assembly can rotate about a vertical axis, so that the dental chair can be easily rotated to any desired orientation. For locking the chair in any given orientation, the lifting assembly includes locking means including an actuator and a friction member connected by locking linkage means. Operation of the actuator causes the friction means to bear against the pedestal to prevent rotation of the chair. The locking linkage means is eccentrically mounted to the actuator such that the actuator will remain in the locking position until removed.

These and other features, objects and advantages of the invention will become apparent in the detailed description and claims to follow taken in conjunction with the accompanying drawings.

DETAILED DESCRIPTION OF THE DRAWINGS

Figure 1:
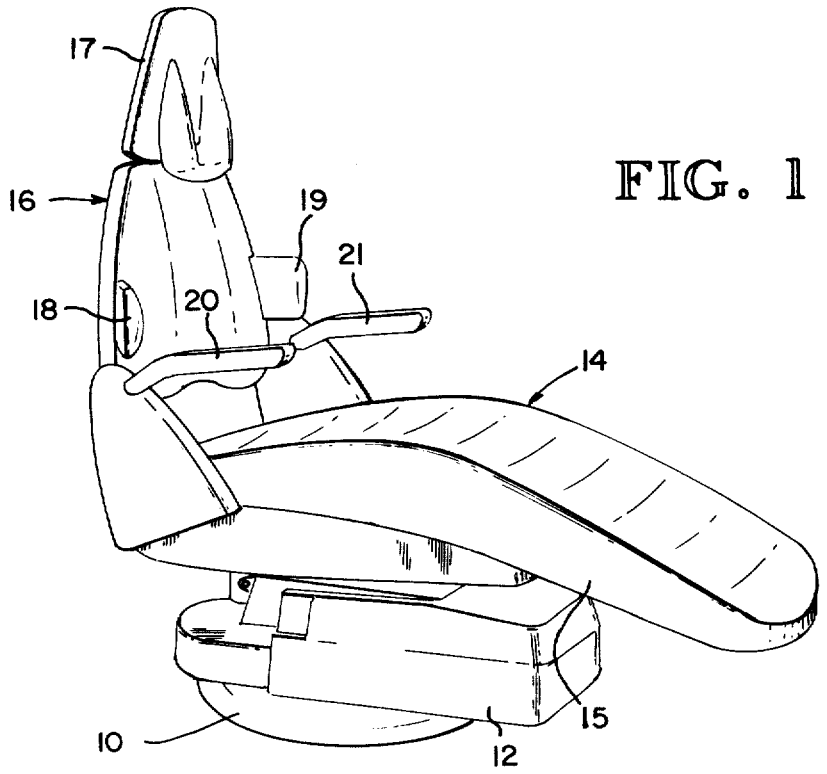
FIG. 1 is a perspective view of the dental chair of the present invention.

FIG. 1 presents an overall view of a dental chair according to the present invention. The dental chair comprises a pedestal 10, support assembly 12, seat 14, backrest 16, and armrests 20, 21. The seat includes extended cushion member 15 to provide full length support for the patient. The backrest includes headrest 17 and wing supports 18, 19. The support assembly can be rotated on the pedestal about a vertical axis, so that the dental chair can be turned to any desired orientation. The support assembly itself includes lifting means for varying the elevation of the seat. A single adjustment means located in the seat allows the seat to move between a lowered, substantially horizontal position and an elevated position, while the backrest is simultaneously moved between an upright and a reclined position. In FIG. 1, the seat and backrest are shown in their lowered and upright positions respectively.

Figure 2:
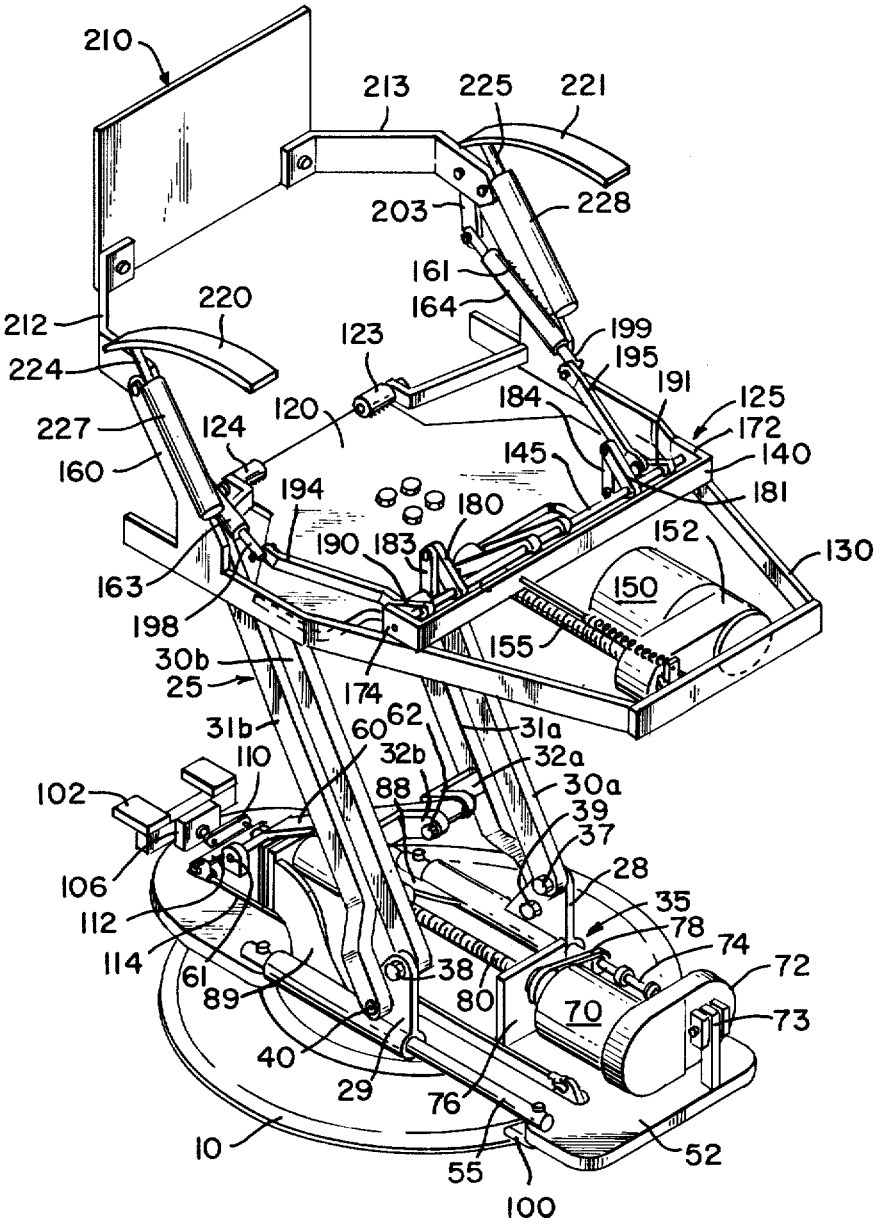
FIG. 2 is a perspective view of the dental chair of FIG. 1 with coverings and parts cut away to reveal the adjustment mechanisms.

FIG. 2 shows the dental chair stripped down to its support and adjustment structures. The support assembly of FIG. 1 is seen to be comprised of a parallelogram assembly 25 and a lifting assembly 35. The lifting assembly is mounted on pedestal 10 by conventional means (not shown) to permit rotation of the lifting assembly, and therefore of the seat, about a vertical axis.

Figure 3:
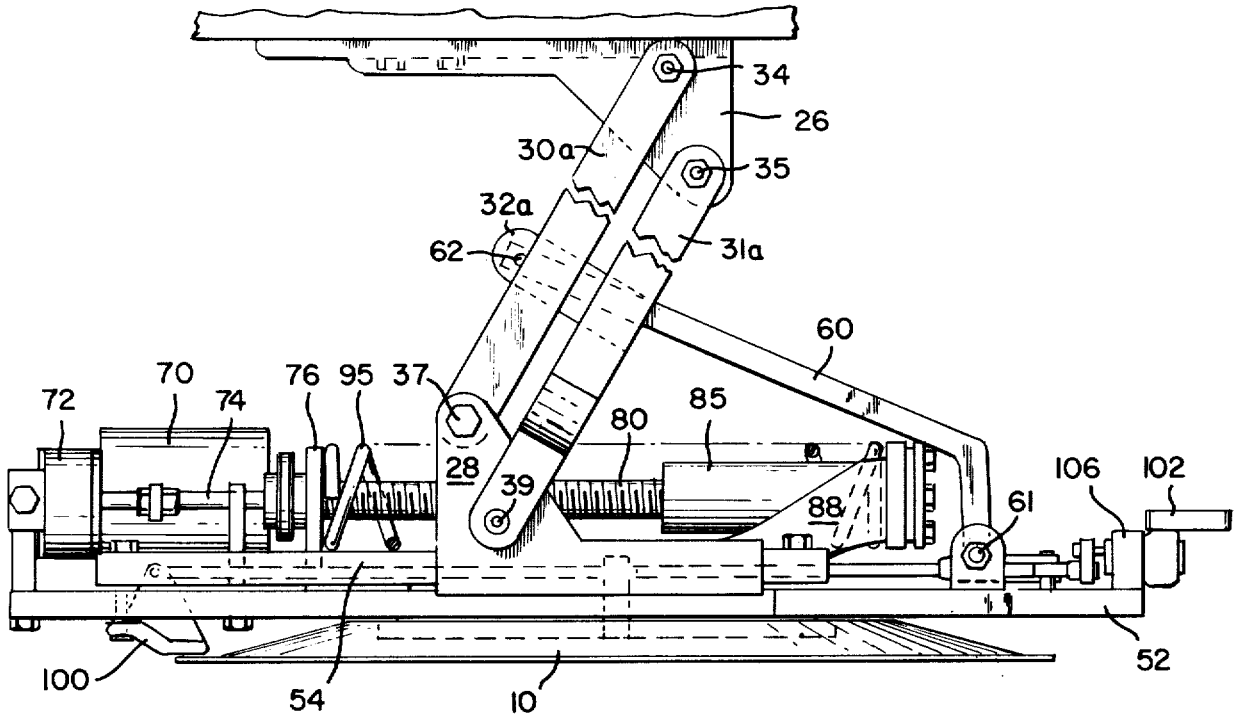
FIG. 3 is a side elevational view of the pedestal and support assembly of the dental chair of FIG. 2 with the chair in an elevated position.

Referring now to FIGS. 2–5, the parallelogram assembly is comprised of an upper member 26, a pair of lower members 28, 29, upper arm pair 30*a*, 30*b*, and lower arm pair 31*a*, 31*b*. Connecting members 32*a*, 32*b* extend inwardly from lower arms 31*a*, 31*b* respectively for connection to the lifting assembly as described below. Each arm is pivotally connected at its upper end to upper member 26, the connections for arms 30*a* and 31*a* being at points 34, 35 respectively (FIG. 3). The connections for arms 30*b* and 31*b* are similar but not shown. Arms 30*a*, 31*a* are pivotally connected at 37, 39 respectively to lower member 28, and arms 30*b*, 31*b* are pivotally connected at 38, 40 respectively to lower member 29. Members 26, 28, 29, and arm pairs 30*a*, 30*b*, 31*a*, 31*b* comprise a parallelogram assembly. Such an assembly has the well known property that the relative orientations of members 26, 28, and 29 will not change as they are rotated about one another. Since, as described below, the orientation of lower members 28, 29 does not change as the chair elevation is adjusted, the orientation of the upper member, which mounts the seat, will likewise not change. Thus the seat will not tilt as the dental chair is raised or lowered.

Figure 4:
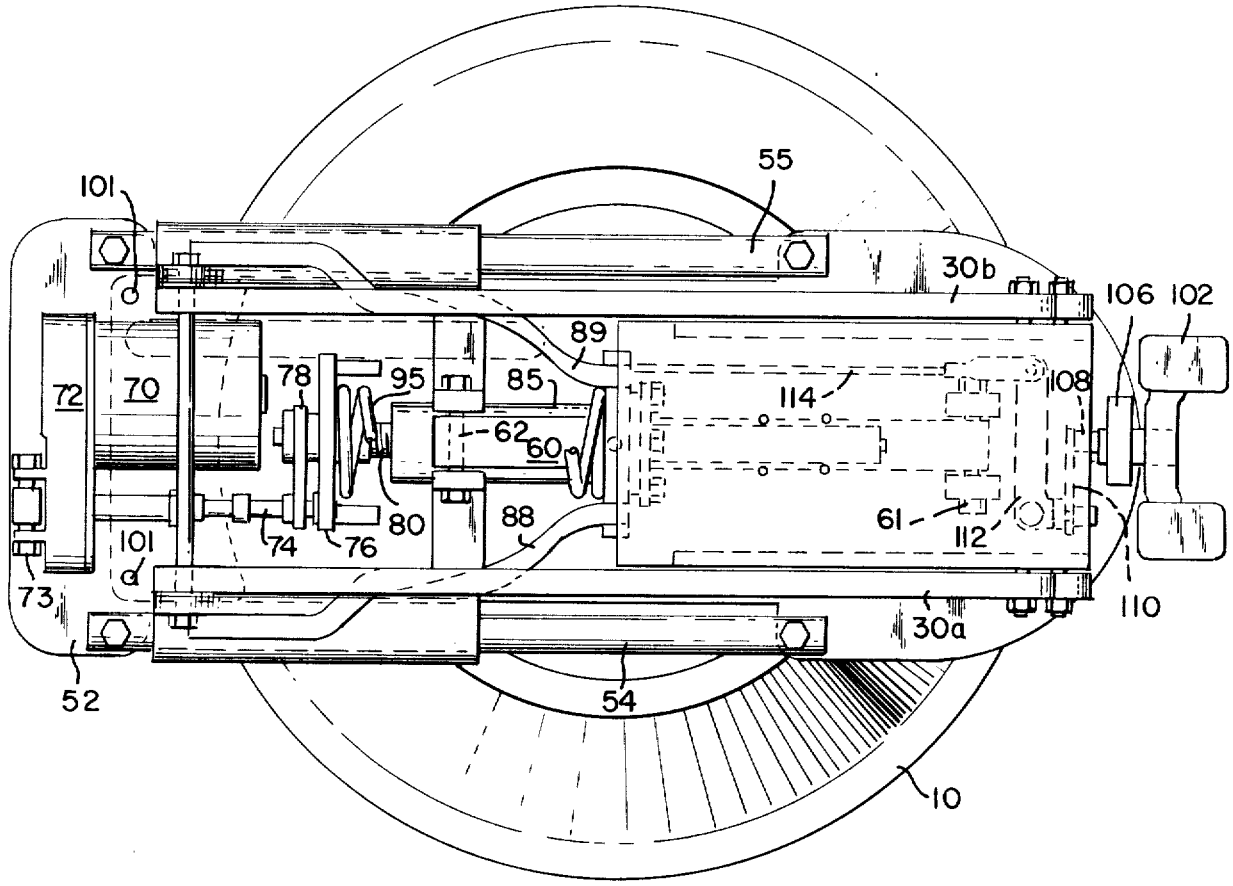
FIG. 4 is a top view of the pedestal and support assembly of the dental chair of FIG. 2.
Figure 5:
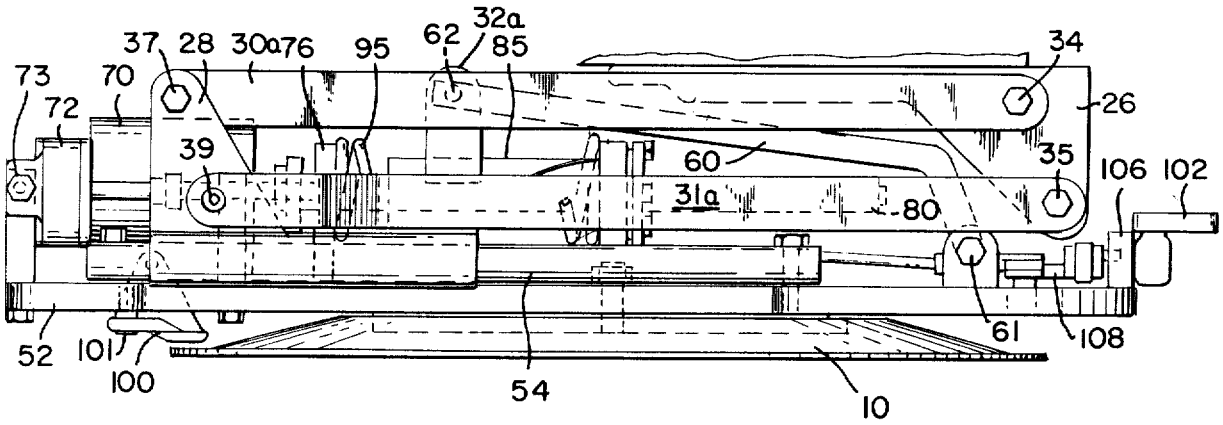
FIG. 5 is a side elevational view of the pedestal and support assembly of the dental chair of FIG. 2 with the chair in a lowered position.

Lifting assembly 35 comprises a base 52, guides 54, 55, elevation link bar 60 (FIG. 3) and reversible electric motor 70. Guides 54, 55 comprise cylindrical tubes bolted to the base 52 such that the guides are substantially horizontal. Lower members 28, 29 are slidably mounted on guides 54, 55 respectively for substantially horizontal movement thereon. Elevation link bar 60 is pivotally connected to base 52 at pivot point 61 and to connecting members 32*a*, 32*b* at pivot point 62. Referring to FIGS. 2–4, it can be seen that movement of the lower members 28, 29 along their respective guides in the direction of pivot point 61 will cause elevation link bar 60 to bear against and raise the arm pairs, so that upper member 26 and the seat carried thereon will likewise be raised. Similarly, movement of the lower members away from pivot point 61 will result in lowering of the upper member and the seat. FIGS. 3 and 5 illustrate such raised and lowered positions respectively.

The configuration of the lifting assembly and parallelogram assembly just described provides the mechanism for raising and lowering the dental chair seat without substantial horizontal movement thereof. Referring again to FIGS. 3 and 5, motion of the entire parallelogram assembly towards pivot point 61 results in horizontal motion of the upper member towards such pivot, while the simultaneous upward swinging of the arm pairs tends to move the upper member in the opposite horizontal direction. These two motions cancel and yield a motion of the upper member which is almost entirely vertical over the range of motion permitted by the guides. To achieve such essentially vertical motion while at the same time having lifting and parallelogram assemblies which are compact in their lowered positions (FIG. 5), pivot point 62 between connecting members 32*a*, 32*b* and elevation link bar 60 is preferably closer to lower members 28, 29 than to upper member 26.

The means for moving lower members 28, 29 along guides 54, 55 is illustrated in FIGS. 2–4. Such means comprises reversible electric motor 70, gear reduction means 72, worm gear 80 and internally threaded collar 85. Motor 70 is mounted to the gear reduction means which in turn is mounted to base 52 by mounting means 73. The output shaft 74 of the gear reduction means is journaled in plate 76 upstanding from the base. One end of worm gear 80 is also journaled in plate 76, while the other end is threadably engaged by collar 85. Pulleys mounted on output shaft 74 and worm gear 80 are connected by flexible belt 78. Collar 85 is connected by yoke arms 88, 89 to lower members 28, 29 respectively. Thus rotation of motor 70 causes worm gear 80 to turn, which causes threaded collar 85 to move horizontally thereon. Such horizontal motion is transmitted via yoke arms 88, 89 to the lower members 28, 29, moving them along the guides 54, 55.

Lifting assembly 35 further comprises spring 95 mounted therein to assist motor 70 in raising the seat and to provide a backup safety system should the motor or linkage thereto fail. The spring is concentrically mounted about worm gear 80 and it extends between threaded collar 85 and plate 76. Motion of the threaded collar along the worm gear thereby causes compression or relaxation of the spring so as to assist in raising the seat and to resist downward motion thereof.

As previously stated, lifting assembly 35 is mounted on pedestal 10 for rotation about a vertical axis so that the dentist can turn the dental chair to its most convenient orientation for a given task. In order that the chair may be held fixed in position during such task, locking means are provided for holding the lifting assembly fixed in orientation with respect to the pedestal. Referring to FIGS. 2–5, 9 and 10, such locking means comprises friction member 100, actuator pedal 102, and linkage therebetween. Friction member 100 is loosely mounted at points 101 to base 52 via shoulder bolts 103 and bushings 105 so that it can rock to and from a position in which it bears against the pedestal. The pedestal has circular symmetry so that friction member 100 will have a constant position with respect to the pedestal during rotation of the lifting assembly.

Actuator 102 is secured to shaft 104 which is journaled in block 106 upstanding from the base. Pin 108 is eccentrically mounted in the end of shaft 104, such that rotation of the shaft via actuator 102 results in back and forth motion of pin 108. This back and forth motion is transferred via link 110 into rotational motion of lever 112 about pivot point 113 mounted in the base. Link arm 114 connects lever 112 to friction member 100, such that rotation of the lever about its pivot point will move friction member 100 into and out of contact with pedestal 10.

Figure 6:
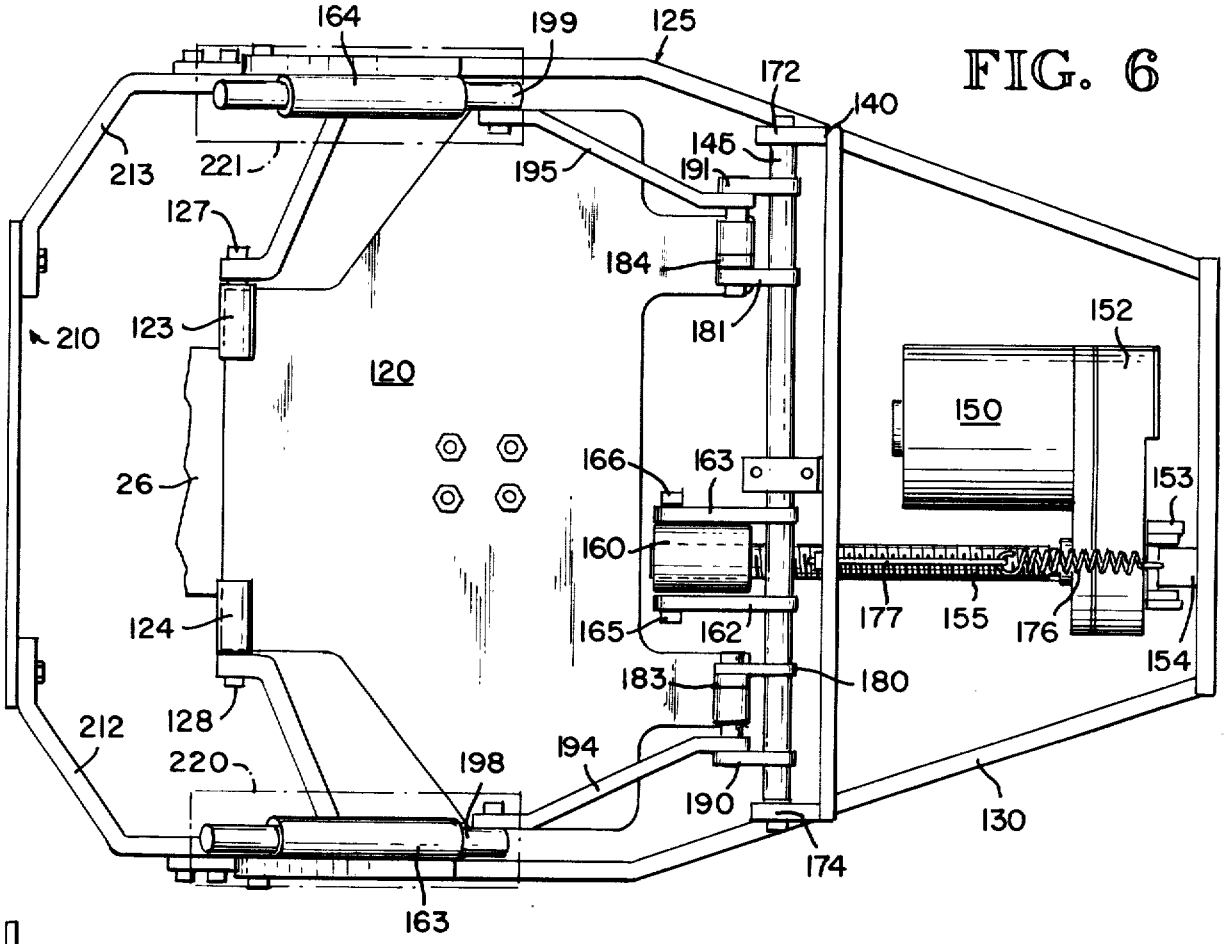
FIG. 6 is a top view of the seat assembly of the dental chair of FIG. 2.

Referring now to FIGS. 1, 2 and 6, seat 14 comprises a seat assembly 125 which provides the rigid support and adjustment features of the seat. Seat assembly 125 comprises a seat frame 130 together with the structures, described below, mounted thereon. Connecting plate 120 is mounted atop upper member 26 and secured thereto by bolts or other suitable means. At its rearward corners, plate 120 carries two internally threaded sleeves 123, 124. Seat frame 130 is pivotally connected near its rearward end to plate 120 by pins 127, 128 passing through the seat frame into such sleeves. Thus the rear of seat frame 130 is fixed to the support assembly whereas the front of the seat frame may be pivoted upwards.

Reversible electric motor 150 and associated drive reduction means 152 is secured to seat frame 130 within the forward end thereof by motor mounting bracket 153 and eyelet 154 extending from seat frame 130. Gear reduction means 152 supports one end of and drives worm gear 155. The other end of worm gear 155 rides in internally threaded collar 160 which is pivotally linked to transverse shaft 145 by means of yolk arms 162, 163 and pins 165, 166 (FIG. 6). Transverse shaft 145 is journaled in shaft mounting bracket 140 at points 172, 174. This bracket extends across the top of and is secured to seat frame 130. Spring 176 and link 177 connect the motor mounting bracket 153 and shaft mounting bracket 140 to reduce motor vibration.

Figure 7:
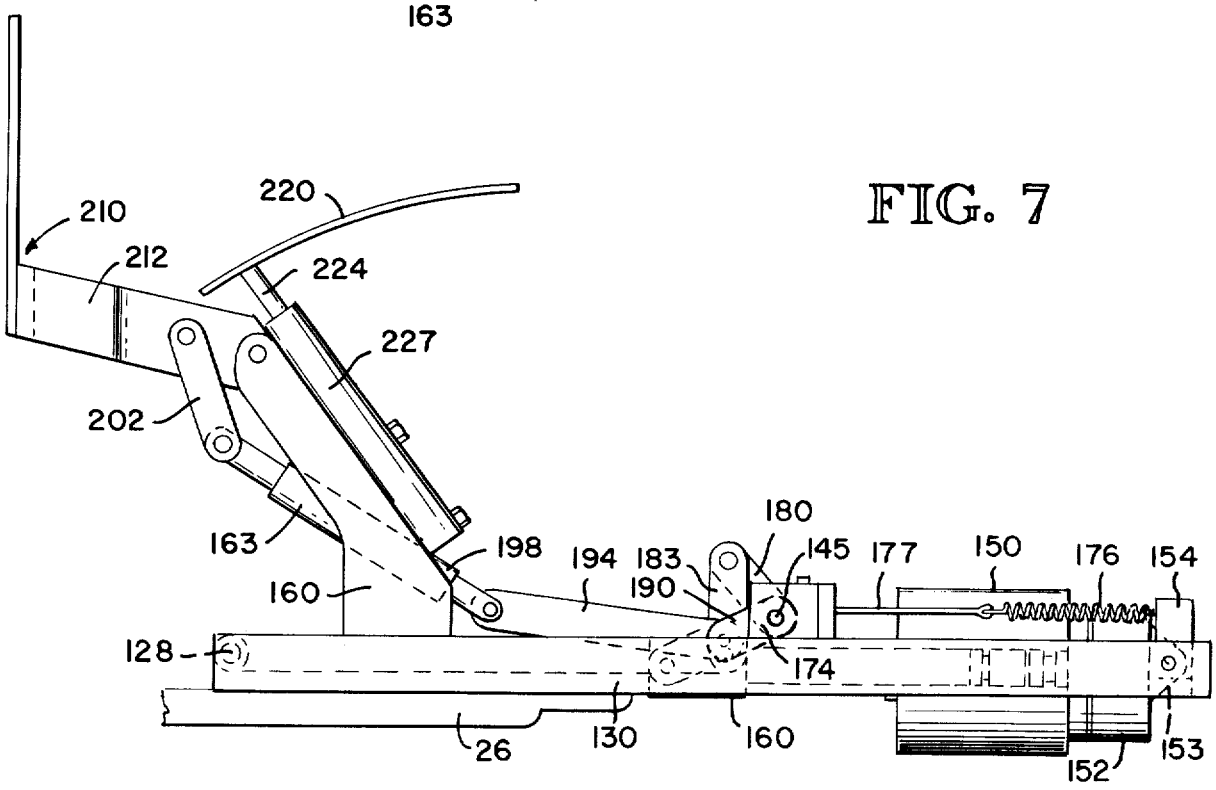
FIG. 7 is a side elevational view of the seat and backrest assemblies of the dental chair of FIG. 2 in their lowered and upright positions respectively.
Figure 8:
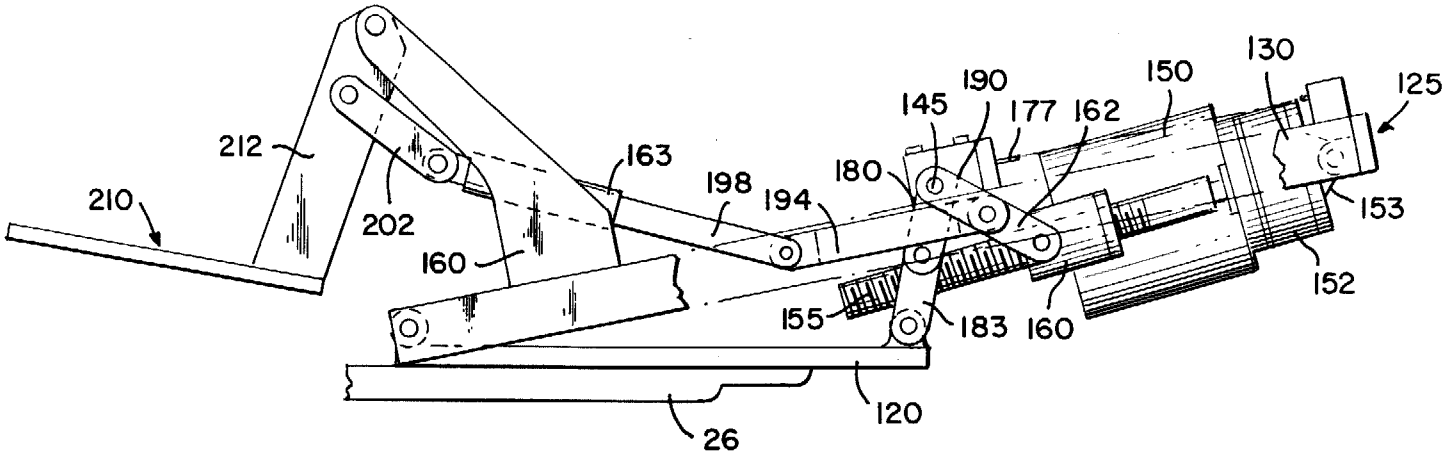
FIG. 8 is a side elevational view of the seat and backrest assemblies of the dental chair of FIG. 2 in their elevated and reclined positions respectively.
Figure 9:
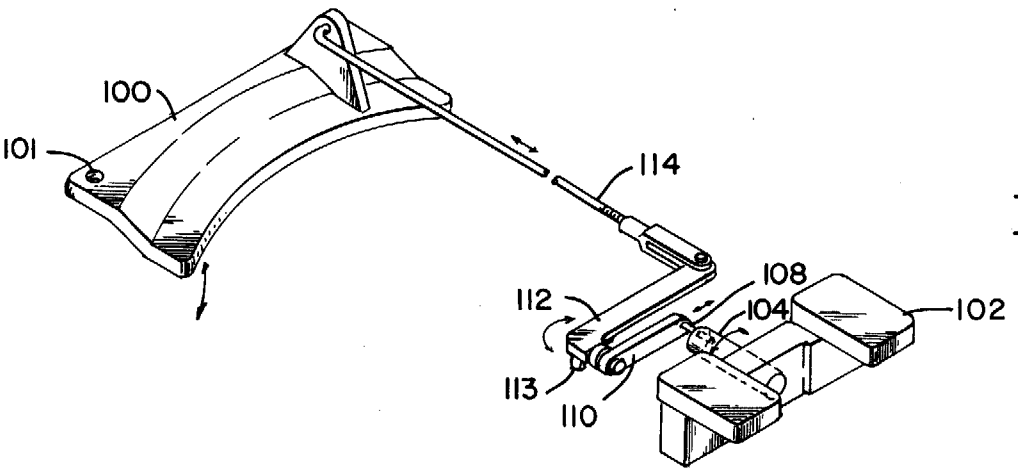
FIG. 9 is a perspective view of the locking assembly of the dental chair of FIG. 2.
Figure 10:
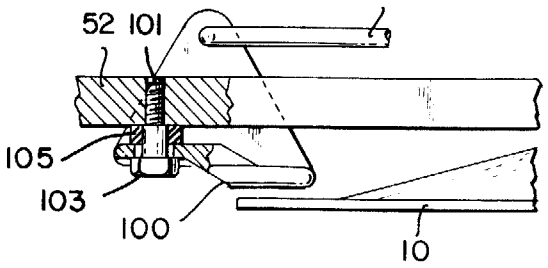
FIG. 10 is a partly broken away side elevational view of a portion of the locking assembly of FIG. 9.

Lever arms 180, 181 extend from transverse shaft 145 and pivotally connect with links 183, 184 respectively, such links being in turn pivotally linked to connecting plate 120. Operation of motor 150 causes worm gear 155 to turn, which then rotates transverse shaft 145 by means of threaded collar 160 and yolk arms 162, 163 previously described. Rotation of transverse shaft 145 in a counterclockwise direction (FIG. 7) causes lever arms 180, 181 to push downward on links 183, 184, causing the entire seat assembly 125 to pivot upwards about pins 127 and 128 such that its front end rises to the configuration shown in FIG. 8. Operation of reversible electric motor 150 will therefore cause the seat assembly, as well as cushion member 15 (FIG. 1) mounted thereon, to move between lowered and elevated positions, as indicated by FIGS. 7 and 8 respectively.

Backrest 16 (FIG. 1) includes backrest assembly 210 which provides the rigid support and adjustment features of the backrest. Backrest assembly 210 comprises two members 212, 213 which extend therefrom and pivotally connect to armrest supports 160, 161 which are part of seat assembly 125. As is most clearly shown in FIGS. 2 and 6, lever arms 190, 191 extend from transverse shaft 145 and pivotally connect to links 194, 195 which links pivotally connect to links 198, 199 slidably contained in guides 163, 164. After passing through such guides, links 198, 199 are pivotally connected via links 202, 203 to members 212, 213. By such means, counterclockwise rotation of transverse shaft 145 (FIG. 7) will cause lever arms 190, 191 to pull against linkages consisting of links 194, 198, 202, and 195, 199, 203 respectively to move the backrest assembly from its upright position (FIG. 7) to its reclined position (FIG. 8). Clockwise rotation of transverse shaft 145 will push against such linkages to cause the backrest assembly to move in an opposite direction from its reclined to its upright position.

The combined motion of the seat and backrest assemblies may now be described. Referring to FIGS. 7 and 8, counterclockwise rotation of transverse shaft 145 in the position shown in FIG. 7 will cause the seat assembly, comprising seat frame 130 and the structure carried thereon, to rise with respect to upper member 26. At the same time the backrest assembly 210 will rotate counterclockwise with respect to the seat assembly. The result will be that the seat and backrest assemblies will move in unison from their respective lowered and upright positions (FIG. 7) to their respective elevated and reclined positions. Thus by operation of reversible electric motor 150, by switch means not shown, the dentist can select from a continuous range of interrelated seat and backrest positions to place the patient in an optimum position for a given treatment.

The dental chair of the present invention includes armrests 220, 221 (FIGS. 2 and 7) rotatably mounted by depending cylindrical members 224, 225 in tubular supports 227, 228. The tubular supports are mounted on armrest supports 160, 161. Preferably, cylindrical members 224, 225 contain slots (not shown) at their lower ends for engaging stops (not shown) contained within the tubular supports, such that the armrests are locked against rotating when in their normal positions (FIGS. 2 and 7) but can be rotated by first lifting them upwards such that the slots are moved clear of the stops.

While the preferred embodiment of this invention has been illustrated and described herein, it should be understood that variations will become apparent to one skilled in the art. Accordingly, the invention is not to be limited to the specific embodiment illustrated and described herein and the true scope and spirit of the invention are to be determined by reference to the appended claims.

What is claimed is:

1. A dental chair, comprising:

a pedestal;

a lifting assembly mounted on the pedestal, said lifting assembly comprising a base, substantially horizontal guide means mounted on the base, elevation link means having first and second ends and being pivotally mounted to the base at its first end, and elevation drive means mounted on the base;

a parallelogram assembly including upper and lower members and a plurality of parallel arms pivotally connected therebetween, the length of said arms being longer than the distance between the pivotal connections of said arms, there said lower member, said lower member being slidably mounted on the guide means and directly connected to the elevation drive means such that said drive means effects movement of said lower member along the guide means, and said elevation link means being pivotally connected at its second end to one of said arms between the midpoint of said arm and its connection to said lower member in such a manner as to act in reaction to the movement of said lower member along said guide means for causing substantially vertical movement of the upper member between raised and lowered positions when the lower member is moved along the guide means;

a seat assembly mounted to the upper member;

a backrest assembly mounted to the seat assembly.

2. The dental chair of claim 1, wherein said elevation drive means comprises an electric motor, a worm gear driven by said motor, and a threaded collar mounted on said worm gear and linked to said lower member.

3. The dental chair of claim 2, wherein the elevation drive means further comprises elevation assisting means operatively associated with the parallelogram assembly and with the lifting assembly such that said elevation assisting means assists raising of the said upper member and resists lowering of said upper member.

4. The dental chair of claim 3, wherein said elevation assisting means comprises a spring mounted such that it surrounds the worm gear.

5. A dental chair as in claim 1 wherein said guide means is an elongated cylindrical member for insuring greater strength.

6. A dental chair as in claim 1 wherein said arms are displaced in a vertical direction such that when the chair is in a lowered position one arm is substantially above the other for creating a low profile when lowered.

7. A dental chair, comprising:

a pedestal;

a lifting assembly mounted on the pedestal for rotation about a vertical axis, said lifting assembly comprising a base, substantially horizontal guide means mounted on the base, elevation link means having first and second ends and being pivotally mounted to the base at its first end, and elevation drive means mounted on the base;

a parallelogram assembly including upper and lower members and a plurality of arms extending therebetween, said lower member being slidably mounted on the guide means and operatively connected to the elevation drive means such that said drive means is capable of causing said lower member to move along the guide means, and said elevation link means being pivotally connected at its second end to one of said arms for causing substantially vertical movement of the upper member between raised and lowered positions when the lower member is moved along the guide means;

a seat assembly mounted to the upper member;

a backrest assembly mounted to the seat assembly;

locking means mounted on the lifting assembly, said locking means including a friction member, actuating means, and locking linkage means connecting said actuating means to said friction member such that the motion of the actuator causes said friction member to move to and from a position in which it bears against the pedestal, said locking linkage means being eccentrically connected to the actuator for holding said friction member in a position in which it bears against the pedestal.

* * * * *